US007506781B2

(12) United States Patent
Roberts

(10) Patent No.: US 7,506,781 B2
(45) Date of Patent: Mar. 24, 2009

(54) GOLF BALL POSITIONING DISPENSER FOR PUTTING PRACTICE

(76) Inventor: John G. Roberts, 140 Uwapo Rd., Kihea, HI (US) 96753

( * ) Notice: Subject to any disclaimer, the term of this patent is extended or adjusted under 35 U.S.C. 154(b) by 195 days.

(21) Appl. No.: 11/797,617

(22) Filed: May 4, 2007

(65) Prior Publication Data

US 2008/0274838 A1 Nov. 6, 2008

(51) Int. Cl.
*A63B 69/36* (2006.01)

(52) U.S. Cl. ..... 221/279; 221/151; 221/178; 221/208; 221/215; 221/273; 221/311; 473/405

(58) Field of Classification Search ..... 221/4, 221/5, 12, 13, 15, 23, 66, 75, 79, 81, 82, 221/83, 86, 89, 105, 113, 151, 152, 167, 221/168, 170, 172, 177, 178, 180, 181, 186, 221/194, 199, 207, 219, 222, 223, 232, 233, 221/234, 235, 237, 243, 265, 268, 271, 272, 221/273, 274, 275, 276, 277, 279, 280, 281, 221/284, 285, 288, 289, 293, 295, 297, 298, 221/299, 300, 301, 311; 473/132, 133, 134, 473/135, 136, 137, 405

See application file for complete search history.

(56) References Cited

U.S. PATENT DOCUMENTS 1,778,952 A * 10/1930 McCullough ..... 221/301
1,868,261 A * 7/1932 Spencer ..... 473/134
1,937,180 A 11/1933 Young
1,958,956 A * 5/1934 Preston ..... 221/282
2,962,321 A * 11/1960 Fowler et al. ..... 294/19.2
3,206,067 A * 9/1965 Smith, Jr. et al. ..... 221/281
4,141,558 A * 2/1979 Hoffman ..... 473/132
4,575,092 A 3/1986 Watson
4,676,397 A * 6/1987 Hoffmeister ..... 221/105
5,147,101 A 9/1992 Tiller
D371,179 S 6/1996 Park
5,996,839 A * 12/1999 McLinn ..... 221/174
6,182,983 B1 * 2/2001 Kim ..... 280/47.26

(Continued)

OTHER PUBLICATIONS

"DW Quail Golf" http://www.dwquailgolf.com/putting.html Retrieved on Jan. 12, 2007.

(Continued)

*Primary Examiner*—Gene Crawford
*Assistant Examiner*—Kelvin L Randall, Jr.
(74) *Attorney, Agent, or Firm*—Richard C. Litman

(57) ABSTRACT

The golf ball positioning dispenser for putting practice comprises a hollow tube for holding golf balls. A stop mechanism attached to a body block near the bottom end of the tube dispenses balls one at a time. The stop mechanism includes a pivotally attached biased lever that controls movement of a ball release pin and a ball retention pin into the tube in alternating cycles. The body block is attached to a travel wheel for circumferential travel around a practice hole. A telescoping radial arm is provided to keep travel of the travel wheel a predetermined user selected radial distance from the hole. Cams attached to the wheel engage the biased lever to dispense the golf balls from the tube at predetermined intervals of arc along a circumference of travel. A stand is included to stabilize the tube in an upright position.

17 Claims, 6 Drawing Sheets

U.S. PATENT DOCUMENTS

| | | | | |
|---|---|---|---|---|
| 6,199,926 | B1 * | 3/2001 | Lemoine | 294/19.2 |
| 6,386,607 | B1 * | 5/2002 | Deininger | 294/19.2 |
| 6,572,167 | B2 | 6/2003 | Deininger | |
| 6,631,828 | B1 * | 10/2003 | Reardon | 221/268 |
| 6,739,477 | B1 * | 5/2004 | Pascual | 221/199 |
| 6,893,356 | B2 | 5/2005 | Thompson | |
| 2002/0092862 | A1 * | 7/2002 | Threadgill, Jr. | 221/283 |
| 2005/0070370 | A1 | 3/2005 | Whitaker | |
| 2005/0277482 | A1 | 12/2005 | Bennett | |
| 2006/0163273 | A1 * | 7/2006 | Pommereau | 221/289 |
| 2008/0146367 | A1 * | 6/2008 | Cruz | 473/286 |

OTHER PUBLICATIONS

"UK Golf Equipment, discount Golf Equipment, Cheap Golf Equipment, Planet Golf" http://www.planetgofuk.co.uk/shop/page.php?page_type_ type=produc_t view&product id=705&SESSION_ID=7a21ad1020b9802d6f106e188be6841f retrieved on Mar. 17, 2007.

* cited by examiner

GOLF BALL POSITIONING DISPENSER FOR PUTTING PRACTICE

BACKGROUND OF THE INVENTION

1. Field of the Invention

The present invention relates to systems and apparatus used as an accessory for sporting games. More specifically, the present invention relates to a portable device having a system for positioning and dispensing golf balls. The present invention is particularly useful for dispensing the golf balls one by one in a predetermined circular pattern for use in a practice putting session designed to improve one's game.

2. Description of the Related Art

In many sporting games, it is commonly advantageous to engage in repetitious practice exercises to improve one's game. The game of golf is no exception, and there are countless devices which have been used to aid the golfer in improving the golfer's performance. In the game of golf, an important aspect of the game is having an accurate putting stroke. To achieve an accurate putting stroke, a golfer can practice by manually placing a bunch of golf balls in a desired pattern on a putting green and then repeatedly hitting them with a putter into holes positioned on the green or artificial practice putting surface.

It should be noted that the manual placement of the golf balls in the pattern desired by the golfer is time consuming and not precise. Moreover, after the golfer has putted the set of balls, attempting to sink them into a designated hole, the golfer must recall where he/she last positioned the balls in order to gain a repeatable putting practice session. This activity requires too much effort on the part of the golfer, and a better method is needed. Moreover, it would be desirable to be able to automatically and repetitively place golf balls onto the putting surface in predictable and desirable positions for practicing putting a set of golf balls.

Thus, a golf ball positioning dispenser for putting practice solving the aforementioned problems is desired.

SUMMARY OF THE INVENTION

The golf ball positioning dispenser for putting practice comprises a hollow tube for holding golf balls. A stop mechanism attached to the bottom end of the tube dispenses balls one at a time. The stop mechanism includes a pivotally attached biased lever that controls movement of a ball release pin and a ball retention pin into the tube in alternating cycles. The mechanism is attached to a travel wheel for circumferential travel around a practice hole. A telescoping radial arm is provided to keep travel of the travel wheel a predetermined radial distance from the hole. Cams attached to the wheel engage the biased lever to dispense the golf balls from the tube at predetermined intervals of arc along a circumference of travel. A stand is included to stabilize the tube when the tube is stationary.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
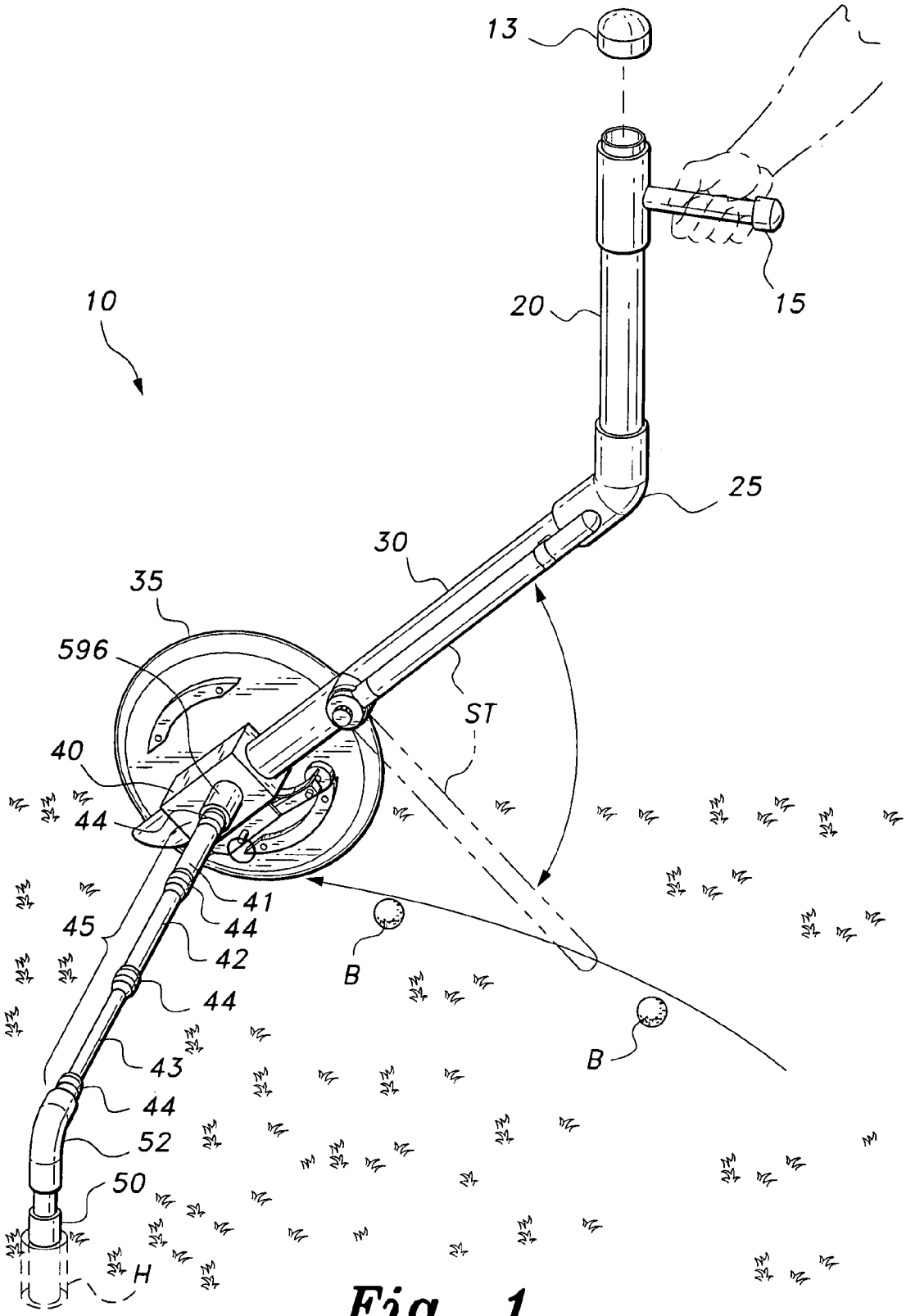
FIG. 1 is an environmental, perspective view of a golf ball positioning dispenser for putting practice, according to the present invention.
Figure 5:
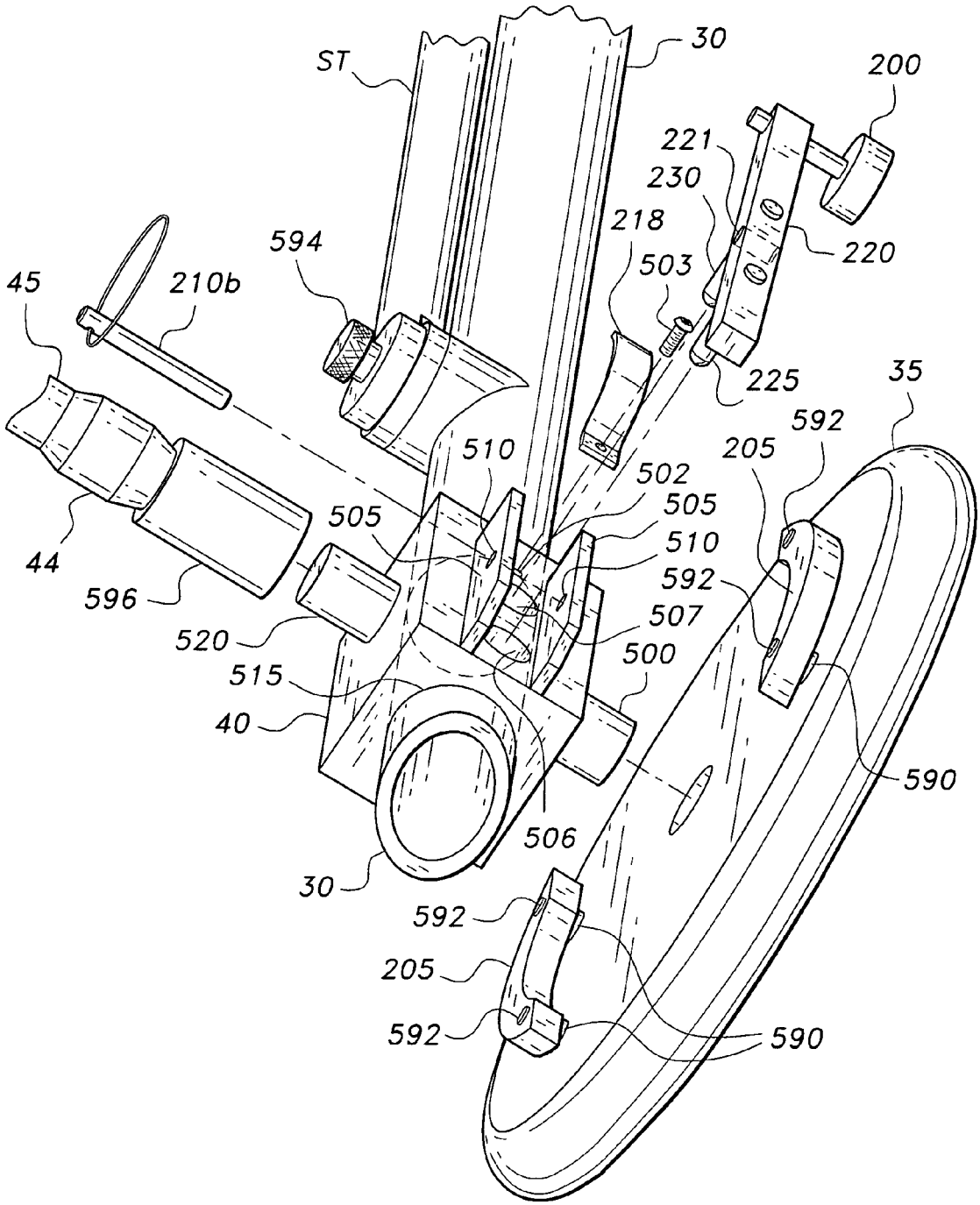
FIG. 5 is a partially exploded, perspective view of the golf ball positioning dispenser, according to the present invention.

As shown in FIG. 1, the present invention 10 comprises a hollow tube 30 for holding and dispensing golf balls B on a lawn, putting green, putting platform, or the like. A ball stop mechanism attached proximate to the bottom end of the tube 30 dispenses balls B one at a time. The ball stop mechanism is attached to body block 40 and includes a pivotally attached spring, gravity, or otherwise biased lever 220, that controls movement of a ball release pin 225 and a ball retention pin 230 into the tube 30 in alternating cycles. The biased lever 220 is biased in a position that retains all of the balls B so that pivoting the lever 220 in a counter-biased direction releases only one of the balls B at a time. As shown in FIG. 5, a threaded spring leaf attachment bore 502 is provided for attachment of a spring leaf 218 to the body block 40 with threaded fastener 503. Body block 40 has longitudinally extending parallel aligned lever attachment guides 505. The lever attachment guides have coaxially aligned through bores 510 that lateral through bore 221 of the biased lever 220 is aligned with to provide a pivotal attachment to the body block 40 using attachment pin 210*b*. The tube 30 fits through longitudinal through bore 515 of the body block 40.

Figure 3A:
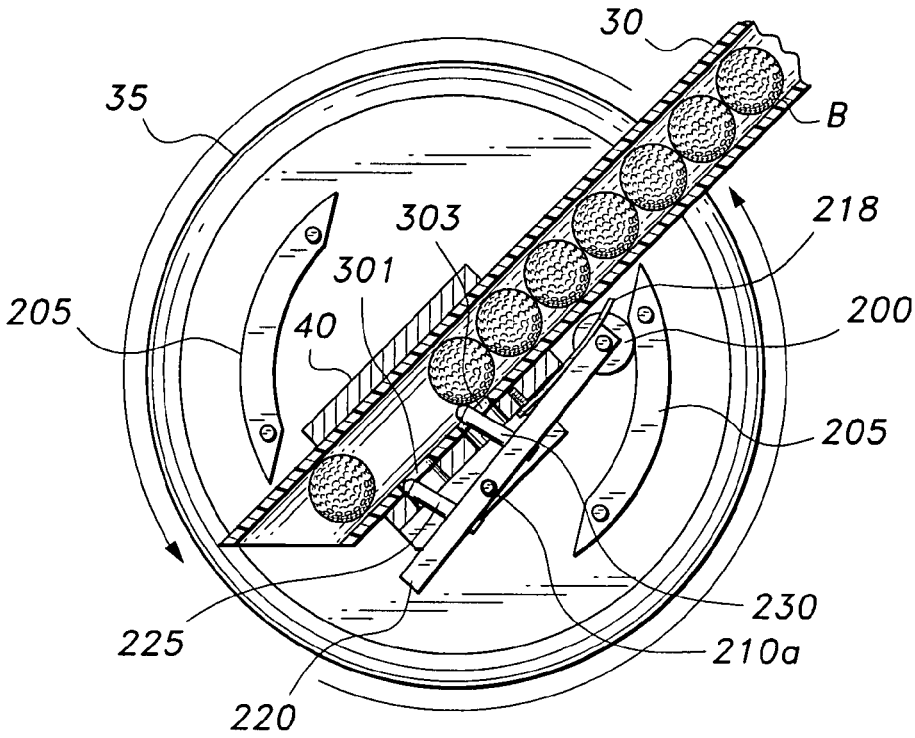
FIG. 3A is a section through the golf ball positioning dispenser, showing a ball being dispensed, according to the present invention.
Figure 3B:
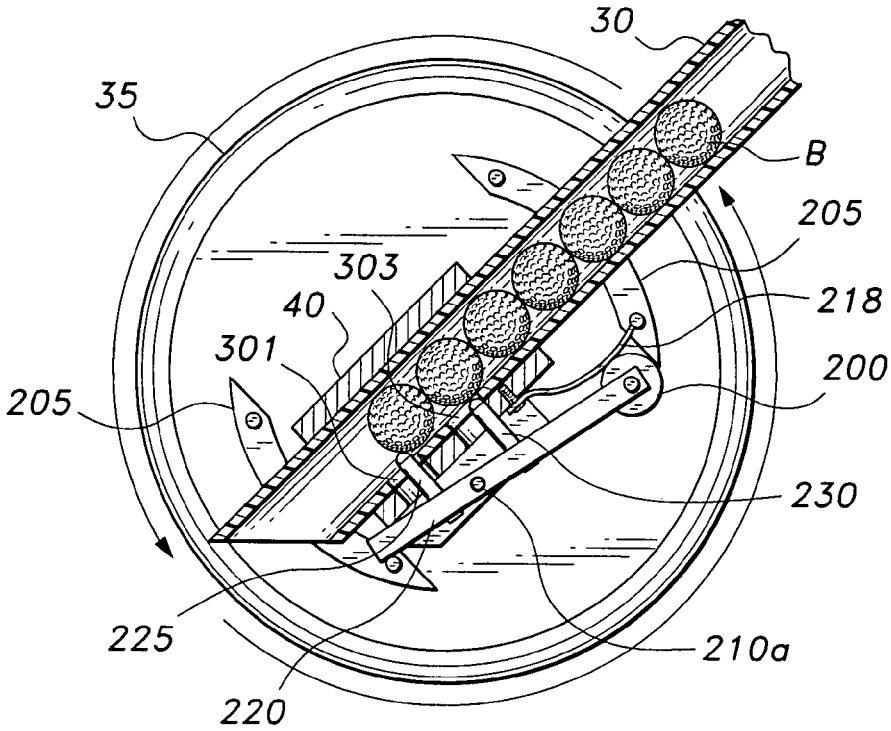
FIG. 3B is a section through the golf ball positioning dispenser, showing remaining balls being retained, according to the present invention.

Referring now to FIGS. 3B and 5, the biased lever 220 is biased by leaf spring 218 so that ball release pin 225 is normally disposed through a ball release pin receiving hole 301 in the tube 30 in order to hold the balls B in a ready position for dispensing. It should be understood that the ball release pin receiving hole 301 is axially aligned with body block ball release pin through bore 506. The ball retention pin 230 is disposed opposite pin 225 on the other side of pivot point 210*a* so that the retention pin 230 is outside of the tube 30 when the ball release pin 225 is inside of the tube 30.

Figure 3C:
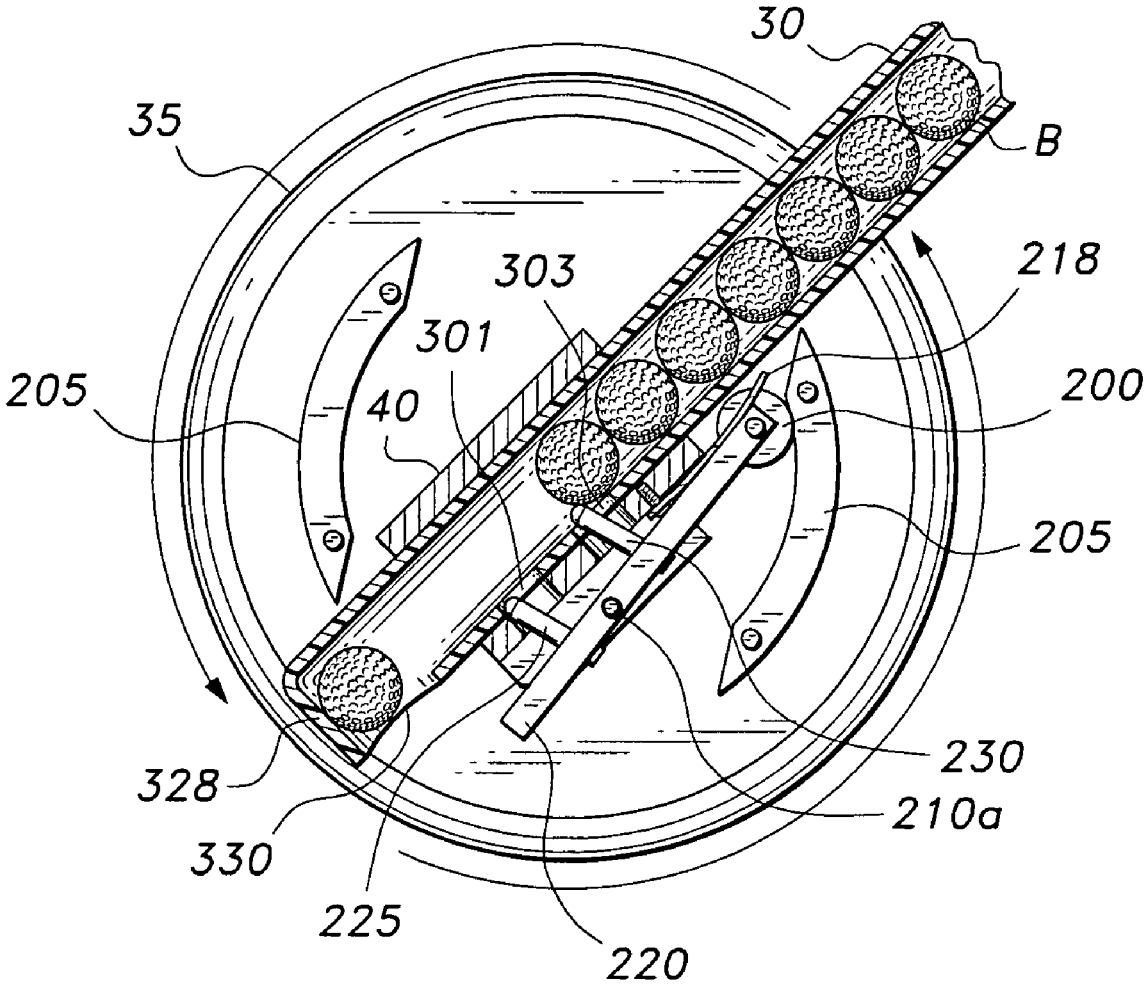
FIG. 3C is a section through the golf ball positioning dispenser, showing a ball being dispensed through an alternative configuration of the dispensing tube, according to the present invention.

Referring now to FIGS. 3A and 5, at least one arcuate shaped cam 205 is disposed on wheel 35, preferably in concentric alignment with an outer circumference of the wheel 35, so that it can engage the biased lever 220 at a bearing 200, capstan, roller, or the like on the lever 220. Cam 205 is attached to the wheel 35 with standoff bushings 590 and fasteners 592. The wheel 35 is freely rotatably attached to the body block 40 at a cylindrical wheel attachment boss 500 that extends from the outer lateral side of body block 40 to form an axle for the wheel 35. The biased lever 220 is disposed proximate to and above the same radial surface of travel wheel 35 that the cam 205 is attached to. As the wheel 35 is rotated, the cam 205 engages the lever 220, causing the biased lever 220 to pivot about the pivot attachment 210*a* in a counter-bias direction which displaces the ball release pin 225 out of its receiving hole 301 in the tube 30 to dispense the lower most single one of the balls B out of the tube 30. It should be understood that the ball retention pin receiving hole is axially aligned with body block ball retention pin through bore 507. At the same time the lower most single one of balls B is being dispensed, the pivot action of biased lever 220 causes the ball retention pin 230 to enter its receiving hole 303 in tube 30 in order to retain the remaining balls B in the tube 30. While, as shown in FIGS. 1 and 5, two cams are disposed on the wheel and displaced an angular distance from each other of 180°, it should be understood that any plurality of cams may be disposed on the travel wheel 35 at any predetermined angular distance from each other on the travel wheel 35. Referring to FIG. 3C, in an alternative configuration of the tube 30, longitudinal end 328 of the tube 30 is closed off and a ball exit hole 330 is disposed proximate the longitudinal end 328 of the tube 30, the ball exit hole 330 preferably having an axial center line that is disposed approximately 90° from a longitudinal axis of the tube 30. This alternative configuration may limit excessive golf ball motion once the dispensed golf ball hits the ground.

Figure 2:
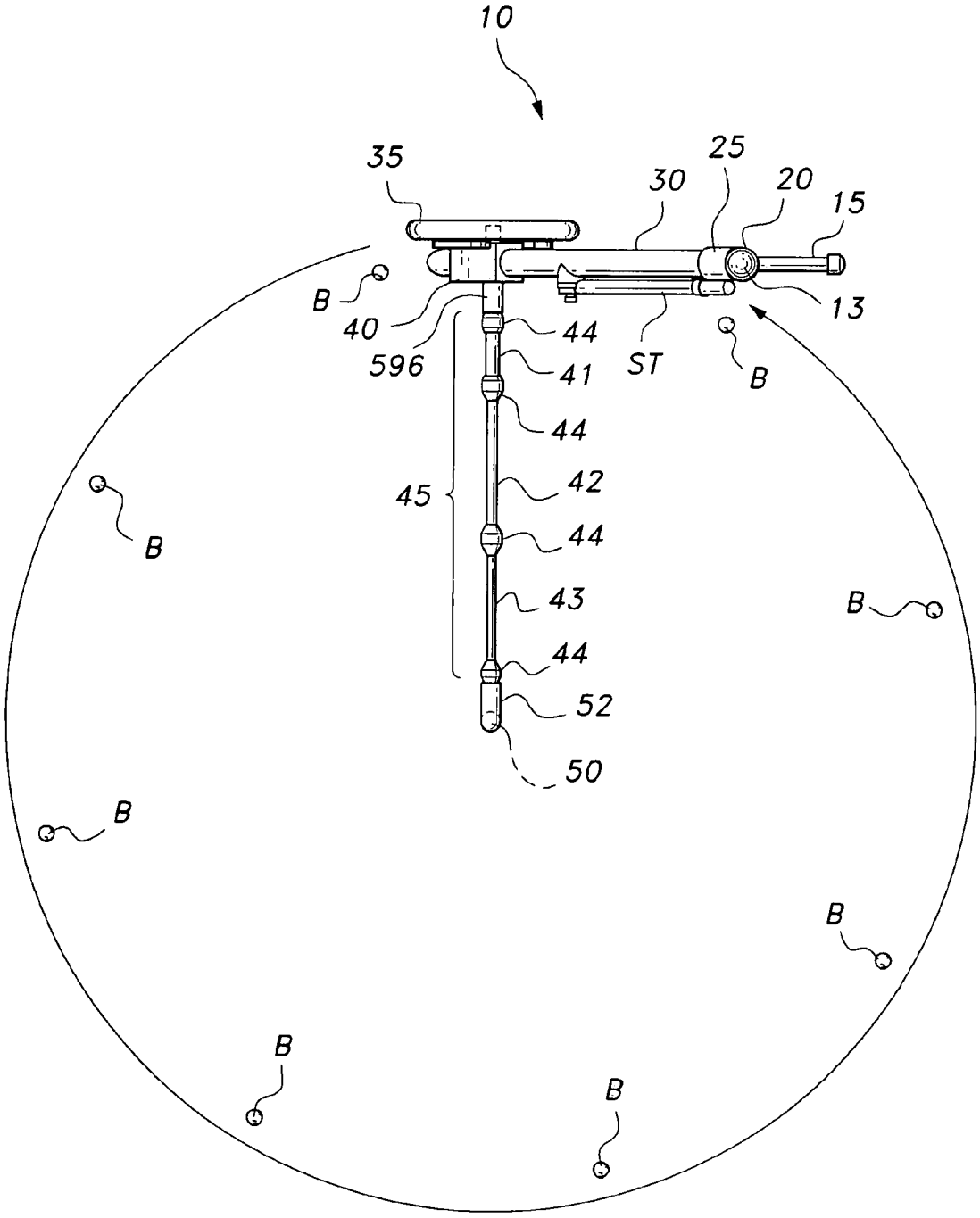
FIG. 2 is a top, environmental view of the golf ball positioning dispenser, according to the present invention.
Figure 4:
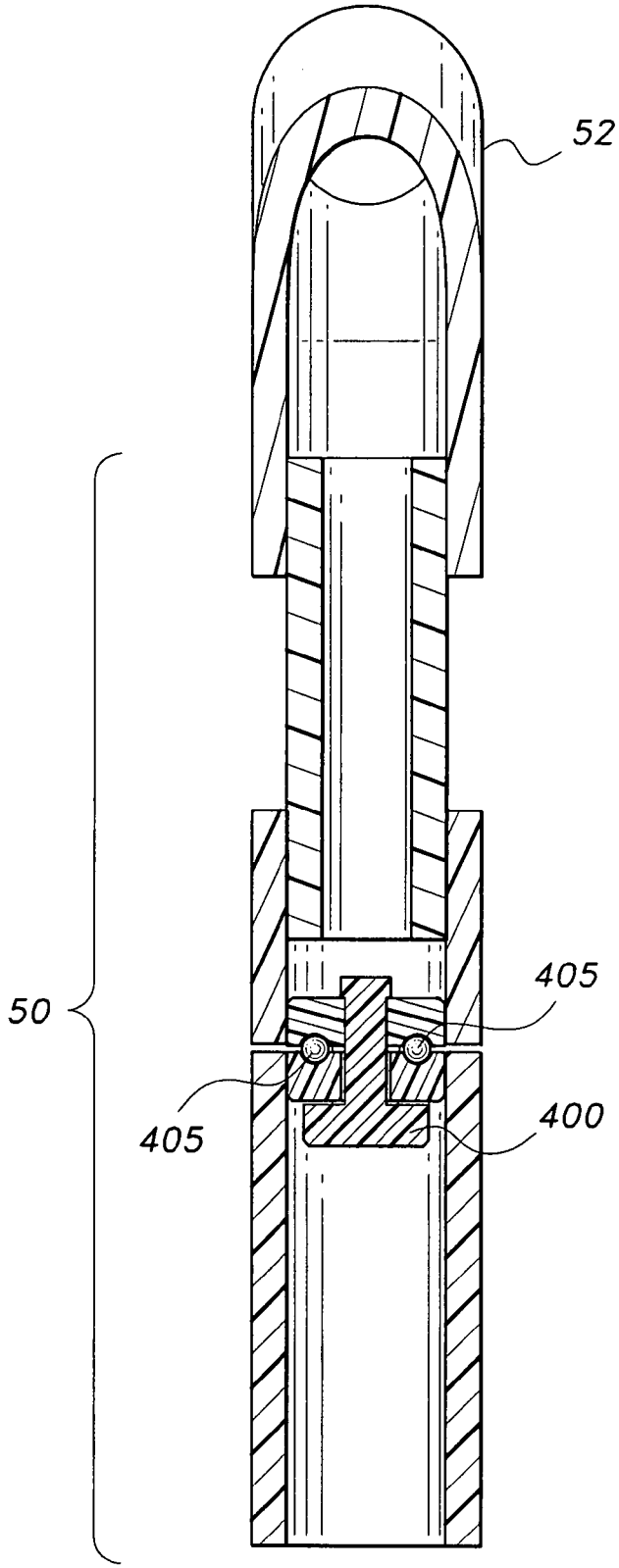
FIG. 4 is a section view of a radial arm bearing assembly and connector of the golf ball positioning dispenser, according to the present invention.

As most clearly shown in FIG. 1, the ball release mechanism, via body block 40, is attached to the travel wheel 35 for circumferential travel around a practice hole H. A radial arm 45, which may be telescoping, is provided to keep travel of the travel wheel 35 a predetermined radial distance from the hole H. As shown in FIG. 5, the radial arm 45 is attached to the dispensing mechanism at cylindrical radial arm attachment boss 520 via radial arm sleeve connector 596. As shown in FIGS. 1-2, the radial arm 45 has a stationary section 41, a first telescoping section 42 and a second telescoping section 43, which may be joined by compression rings 44. Utilizing the telescoping sections 42 and 43, a user can set a desired radial distance, (e.g., at 3 ft, at 6 ft, at 9 ft, or the like), of the dispensing unit 10 from the practice hole H and then lock the sections of the radial arm 45 with the compression rings 44. It should be understood that alternatively to the embodiment shown, radial arm 45 may use a variety of known telescoping configurations utilizing any type of section locking mechanism. The radial arm 45 extends via elbow shaped coupler 52 into a vertically disposed cup attachment member 50. Cup attachment member 50 can be removably inserted into practice hole H. Bottom portion of the cup attachment member 50 is inserted in the ground at practice hole H during ball dispensing operations of the dispenser 10. As shown in FIGS. 2 and 4, upper portion of the coupling member 50 can freely rotate over roller bearing assembly 405 as the radial arm 45 rotates in an arc around the practice hole H. Bearing assembly 405 is held in place by a bearing assembly retention pin 400.

Returning to FIGS. 1, 3A-3B and 5, at least one cam 205 being attached to the wheel 35 can engage the biased lever 220 to dispense the golf balls B from the tube at predetermined intervals of arc along a circumference of travel. A stand comprising an elongated member ST may be swingably attached to the tube by a threaded compression fastener 594 so that a distal end (distal from the tube 30) of the member ST can be swung down to contact the ground and locked in place in order to keep the dispenser 10 in a stable position when stationary. Additionally, tube 30 may be disposed at an angle that is between horizontal and vertical positions, however the tube 30 may extend into a substantially vertically disposed golf ball loading section, or, as shown in FIG. 1, substantially vertical golf ball loading tube 20 may be joined to tube 30 via elbow joint 25. Preferably the tube 30 is inclined to provide a gravity feed of the balls through the tube in the direction of the mechanism positioned at body block 40. Additionally, a grip or handle such as handle 15 may be attached to the ball loading tube 20 near its top to facilitate movement of the dispenser 10 by a user. The top of ball loading tube 20 may be capped off by removable cap 13 that has a compression fit with the tube 20 in order to secure the balls B inside tubes 20 and 30.

It is to be understood that the present invention is not limited to the embodiment described above, but encompasses any and all embodiments within the scope of the following claims.

I claim:

1. A golf ball positioning dispenser for putting practice, comprising:

a hollow tube for holding golf balls; the hollow tube extending through a body block proximate to the bottom end of the tube;

a ball stop mechanism attached to the body block for dispensing the balls one at a time;

the ball stop mechanism having a ball release pin and a ball retention pin, the pins being attached to a biased lever pivotally attached to the body block for movement control of the ball release pin and the ball retention pin into corresponding pin receiving holes of the tube in alternating cycles to provide ball dispensing action;

a travel wheel having a freely rotatable attachment to the body block for circumferential travel around a practice hole;

the biased lever being disposed on the body block so that it is aligned above a radial surface of the travel wheel;

at least one cam attached to the same radial surface of the travel wheel, the at least one cam being capable of engaging the biased lever;

a swingable radial arm extending from a hole position and attached to the body block to keep travel of the travel wheel a predetermined radial distance from the hole; and wherein when a user causes the dispenser to travel via the travel wheel in a circumferential arc of travel determined by the radial arm, the at least one cam engages and alternatively disengages the biased lever to cause the ball dispensing action of the mechanism at predetermined arc intervals along the circumference of wheel travel to place the balls in position one-by-one along the circumference for practice putting.

2. The golf ball positioning dispenser for putting practice according to claim 1, further comprising: a vertical golf ball loading hollow tube being connected to the golf ball holding tube to facilitate a user loading the dispenser with golf balls.

3. The golf ball positioning dispenser for putting practice according to claim 1, further comprising: the bias applied to the lever being provided by a spring leaf attached to the body block and extending to contact the lever, wherein the ball release pin is normally disposed through the ball release pin receiving hole in the tube in order to hold the balls in a ready position for dispensing.

4. The golf ball positioning dispenser for putting practice according to claim 1, further comprising: a roller being attached to an end of the biased lever wherein the cam can engage the biased lever by contacting the roller.

5. The golf ball positioning dispenser for putting practice according to claim 1, wherein the at least one cam is arcuate shaped.

6. The golf ball positioning dispenser for putting practice according to claim 1, wherein the at least one cam is in concentric alignment with an outer circumference of the travel wheel.

7. The golf ball positioning dispenser for putting practice according to claim 1, wherein the at least one cam comprises a plurality of cams displaced a predetermined angular distance from each other on the travel wheel.

8. The golf ball positioning dispenser for putting practice according to claim 1, further comprising: parallel aligned lever attachment guides disposed longitudinally along the body block to facilitate the aligned attachment of the biased lever above a radial surface of the travel wheel.

9. The golf ball positioning dispenser for putting practice according to claim 1, wherein the freely rotatable attachment of the travel wheel to the body block comprises a cylindrical travel wheel attachment boss extending from a lateral side of the body block, the cylindrical travel wheel attachment boss forming an axle for the travel wheel.

10. The golf ball positioning dispenser for putting practice according to claim 1, wherein the attachment of the radial arm to the body block comprises a sleeve of the radial arm being mated to a cylindrical radial arm attachment boss that extends from a lateral side of the body block.

11. The golf ball positioning dispenser for putting practice according to claim 1, wherein the golf ball holding tube is disposed in an inclined position from the horizontal in order to provide a gravity feed of the balls through the tube in the direction of the mechanism positioned at the body block.

12. The golf ball positioning dispenser for putting practice according to claim 1, further comprising: a longitudinal end of the golf ball holding tube being closed off; a ball exit hole being disposed proximate the longitudinal end of the tube; and the ball exit hole having an axial center line that is disposed approximately ninety degrees from a longitudinal axis of the golf ball holding tube.

13. The golf ball positioning dispenser for putting practice according to claim 1, further comprising: a handle extending from the dispenser to facilitate a user guiding the dispenser in motion.

14. The golf ball positioning dispenser for putting practice according to claim 1, further comprising: a removable cap that has a compression fit with the golf ball loading tube in order to secure the balls inside the tube when loaded.

15. The golf ball positioning dispenser for putting practice according to claim 1, further comprising: a stand that is swingably and lockably attached to the ball dispensing tube so that an end of the stand can be swung down to contact the ground and locked in place in order to keep the dispenser in a stable position when stationary.

16. The golf ball positioning dispenser for putting practice according to claim 1, further comprising: the radial arm having telescoping sections; means for locking the telescoping sections; and wherein a user can adjust and lock the radial arm length to a desired radius of travel for the dispenser.

17. The golf ball positioning dispenser for putting practice according to claim 1, further comprising: a vertically disposed cup attachment member having a lower portion and an upper portion separated by bearings so that the upper portion is freely rotatable with respect to the lower portion; the cup attachment member being removably insertable into a practice hole; free end of the radial arm being coupled to the upper portion of the cup attachment member; and wherein the radial arm can freely swing around the practice hole position as a user causes the dispenser to travel along the circumference.

* * * * *